US006998936B2

(12) United States Patent
Grunewald

(10) Patent No.: US 6,998,936 B2
(45) Date of Patent: Feb. 14, 2006

(54) BROADBAND MICROSTRIP DIRECTIONAL COUPLER

(75) Inventor: Jorg Grunewald, Backnang (DE)

(73) Assignee: Marconi Communications GmbH, Backnang (DE)

( * ) Notice: Subject to any disclaimer, the term of this patent is extended or adjusted under 35 U.S.C. 154(b) by 0 days.

(21) Appl. No.: 10/269,727

(22) Filed: Oct. 11, 2002

(65) Prior Publication Data

US 2003/0085773 A1 May 8, 2003

(30) Foreign Application Priority Data

Oct. 13, 2001 (EP) ..... 01124552

(51) Int. Cl.
*H01P 5/18* (2006.01)

(52) U.S. Cl. ..... 333/116; 333/112

(58) Field of Classification Search ..... 333/116, 333/113, 109, 115, 112
See application file for complete search history.

(56) References Cited

U.S. PATENT DOCUMENTS

| | | | | |
|---|---|---|---|---|
| 3,495,492 A | | 2/1970 | Kurzl et al. | |
| 4,027,254 A | | 5/1977 | Gunton et al. | |
| 4,028,643 A | * | 6/1977 | Itoh | 333/113 |
| 4,376,921 A | | 3/1983 | Dickens et al. | |
| 4,394,630 A | | 7/1983 | Kenyon et al. | |
| 4,999,593 A | | 3/1991 | Anderson | |
| 5,159,298 A | | 10/1992 | Dydyk | |
| 5,424,694 A | * | 6/1995 | Maloratsky et al. | 333/112 |
| 5,825,260 A | * | 10/1998 | Ludwig et al. | 333/116 |

FOREIGN PATENT DOCUMENTS

JP 56-138302 10/1981

* cited by examiner

*Primary Examiner*—Dean Takaoka
(74) *Attorney, Agent, or Firm*—Kirschstein, et al.

(57) ABSTRACT

A directional coupler comprises, arranged on a substrate, two first ports connected by a first line and two second ports connected by a second line. The lines extend through a coupling zone in which they are separated by a conductor area not connected to the lines.

8 Claims, 3 Drawing Sheets

BROADBAND MICROSTRIP DIRECTIONAL COUPLER

BACKGROUND OF THE INVENTION

The present invention relates to a broadband directional coupler in microstrip technique.

Such directional couplers are used in high and ultra high frequency applications for coupling a well defined, generally small portion of a signal guided in a first line to a second line and thus to extract it for control or monitoring purposes.

Such a directional coupler generally comprises a substrate on which the two lines extend through a coupling zone in which they influence each other capacitively and magnetically, without direct coupling between the two.

On the first line, signals in general can transit through the coupler in opposite directions.

For many applications, it is important to be able to extract only signals which propagate in one of the two opposite directions in the first line or to be able to distinguish between signals propagating in opposite directions, in order to be able to distinguish, by means of a directional coupler located between a transmitter power stage and an antenna, the output signal of the power stage from a signal eventually reflected by the antenna. For this purpose it is necessary that the directional coupler has a high level of directivity, i.e., if an input signal transits the directional coupler in one direction on the first line, the signal thus induced in the second line shall predominantly propagate in one direction only.

The directivity is achieved by a combined use of capacitive and magnetic coupling. If a point on the second line is capacitively influenced by a signal guided in the first line, signals with equal phase will propagate from it in both directions of the second line. In case of magnetic coupling of a point, the signals propagating from it in opposite directions differ in phase by 180°. This property is made use of in directional couplers by combining capacitive and magnetic coupling such that both contribute to the same extent to the signal generated in the second line, whereby the contributions to a signal propagating in a first direction in the second line interfere constructively and those for a signal propagating in an opposite directions interfere destructively.

Such an effect cannot be achieved by simply arranging the first and second lines in parallel in the coupling zone, for in such a case the coupling is quite predominantly of magnetic type.

It is therefore necessary to find a geometry for the various lines of a directional coupler that favor capacitive coupling over magnetic coupling. A known solution of this problem is shown in FIG. 1. Between input/output ports 1, 2, 3, 4 of the directional coupler, the two lines comprise two coupling lines 5, 6 that extend in parallel to each other in a predetermined distance and influence each other mainly magnetically to an extent depending on their distance. At each end of the parallel coupling lines 5, 6, there are regions with strong capacitive coupling formed by conductor portions 7 extending towards the other coupling line and providing locally a predominantly capacitive coupling.

A similar design is known from U.S. Pat. No. 5,767,763 A1. Here the coupling lines are formed of two portions perpendicular to each other, the ends of which are facing each other and form the regions of strong capacitive coupling.

With a coupler designed according to the prior art scheme of FIG. 1, a good directivity can be achieved for frequencies, the wavelength of which in the lines corresponds to four times the length of coupling lines 5 and 6, respectively.

When this frequency is departed from, the relative phase of the capacitive contributions of the projecting conductor portions 7 changes. Due to the design principle, a satisfying directivity can thus only be obtained within a narrow band around this one frequency.

In order to achieve a more broadband directional coupler, it would be desirable to reduce the length of the coupling zone. However, this is difficult with the prior art design principle, because if a coupling capacity is formed between the first and second lines, this always implies the occurrence of a parasitic capacity between the lines and a ground plane which is located on a side of the substrate opposite to the lines. The existence of this parasitic capacity disturbs the behavior of the coupling zone. Conventionally, such disturbances are compensated by providing the coupling capacities in pairs at a distance of $\lambda/4$, $\lambda$ being the wavelength corresponding to the center frequency of the frequency band in which the coupler is effective. This distance $\lambda/4$ therefore defines a minimum size which the coupling zone must have. If the coupling zone were to be made smaller than this size, the disturbances due to the existence of the coupling capacity would have to be compensated by means of inductive or capacitive auxiliary structures located outside the coupling zone. Since these again must have a wavelength dependent distance from the coupling zone, the compensation can only be effective for a limited frequency band. Therefore, the bandwidth in which a directional coupler has a satisfying directivity can only be improved within narrow limits with the prior art design principle, and a miniaturization of the directional coupler is hardly possible.

Another disadvantage of the prior art design principle is that the coupling lines 5, 6 form a system capable of resonance at the operating frequency of the directional coupler. The resonant enhancement of the currents on the coupling lines leads to increased eradiation compared with non-resonant line portions and thus to losses on the one hand and to a strong influence on the currents in the directional coupler by fields that are reflected at the metallization of the opposite substrate side and reach the coupling zone with a phase delay. Since at present, techniques for preventing or reducing the eradiation are lacking, it is attempted to minimize their disturbing influence by using substrates that are as thin as possible and only induce a moderate phase delay between the currents in the coupling zone and the fields reflected back into it. The mechanical sensitivity of these thin substrates affects the durability of couplers manufactured on them and their production yield.

SUMMARY OF THE INVENTION

One object of the present invention is to provide a directional coupler having a novel design principle that uses little substrate space and provides an extremely high bandwidth.

A further object of the invention is to provide a directional coupler having reduced eradiation.

In the directional coupler according to the invention, the unconnected conductor area located between the lines in the coupling zone has, simply speaking, the function of a series circuit of two capacitors, a first capacitor being formed by the first line and an edge of the unconnected conductor area facing it, and the second capacitor being formed by the second line and an edge of the conductor area facing it. By this design it is possible to vary the coupling capacity between first and second lines widely by varying the shape of the conductor area without causing variations of the parasitic capacities in a similar extent, i.e., if the geometry of the first and second lines and, thereby, their magnetic coupling has been determined, it is possible by a suitable choice of the shape of the unconnected conductor area, to vary the effective coupling capacity between the first and second lines in a wide extent without therefore having to modify the shape or arrangement of these lines. This simplifies the optimization of the conductor geometry of the directional coupler considerably.

Preferably, the two lines of the directional coupler extend in mutually perpendicular directions outside the coupling zone. In this way, a mutual magnetic influence of the lines is essentially excluded outside the coupling zone.

It is particularly preferred that each line is formed of two straight sections meeting each other in the coupling zone forming an angle, wherein the two angles thus defined have a common bisectrix. Parallel coupling lines between input and output lines as shown in FIG. 1 are thus avoided in a directional coupler according to the invention. Thus the dimension of the coupling zone, and, in consequence, the dependency of the behavior of the directional coupler on input frequency are minimized.

The portions of the lines of the directional coupler are each preferably strip shaped and have an end edge perpendicular to the borders of the strips. This allows for an arrangement in which the two portions of each line intersect each other at a corner of their end edge. By an appropriate choice of the width of this intersecting portion, a weakly inductive behavior of the first and second lines can be achieved. Such a behavior is desirable in order to compensate the capacitive influence of the unconnected conductor area on the reflection behavior of the lines.

The unconnected conductor area preferably has a square outline, in particular with edges facing the end edges of the strip shaped conductor portions.

It is known to design a directional coupler symmetrically with respect to a first symmetry axis, with a reflection at the first symmetry axis transforming each of the two lines into itself, in order to achieve a behavior of the directional coupler that is symmetric and independent of the propagation direction of a signal on the first and second lines, respectively. According to the invention, it is preferred that the conducting area is formed of two portions which face the first and second lines, respectively and are connected by a land-type conductor portion. This land-type conductor portion ensures that the presence of the unconnected conductor area only influences the capacitive coupling between the first and second lines but not the inductive coupling. It preferably extends along the symmetry axis.

The portions facing the first and second lines, respectively, are preferably L-shaped, in particular with a leg facing an end edge of a straight conductor portion.

BRIEF DESCRIPTION OF THE DRAWINGS

Further features and advantages of the invention become apparent from the subsequent description of embodiments given with respect to the appended figures.

DETAILED DESCRIPTION OF THE PREFERRED EMBODIMENT

Figure 1:
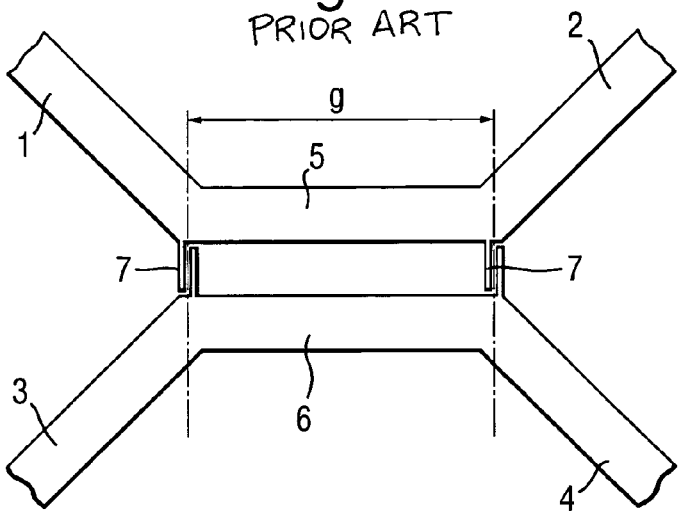
Fig.1. PRIOR ART
FIG. 1, already discussed, is a top view of a prior art directional coupler.
Figure 2:
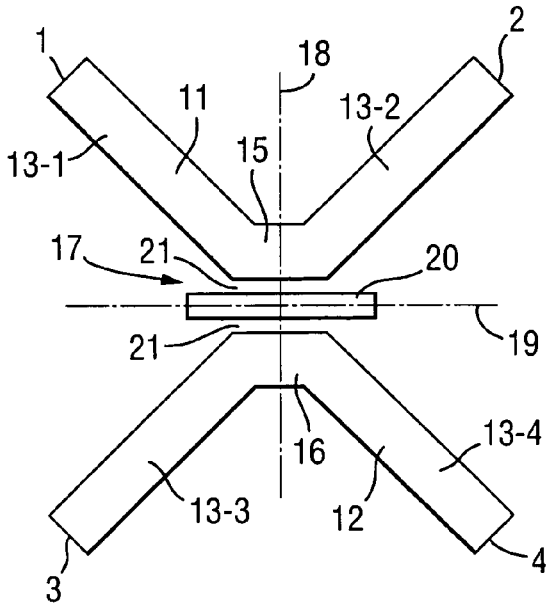
FIGS. 2 to 4 are top views of directional couplers according to first to third embodiments of the present invention.

FIG. 2 illustrates the basic principle of the present invention by means of a top view of a first embodiment of a directional coupler according to the invention. The directional coupler is formed of a substrate 10, e.g., of alumina, having a metallization layer at its bottom side (not shown in the figure) and, at its upper side, two lines 11, 12 formed in microstrip technique, and between these, a conductor area 20 not connected to either of lines 11, 12. Mutually parallel sections of the first and second lines 11, 12 extending at both sides of the unconnected conductor area 20 are referred to as first and second coupling lines 15, 16, respectively; together with the conductor area 20, they form the coupling zone of the directional coupler.

The lines 11, 12 and the unconnected conductor area 20 are formed in a same processing step by locally depositing metal or locally removing metal from a continuous metallization and therefore have the same composition and thickness.

Straight conductor sections 13-1, 13-2, 13-3, 13-4 extend from points 1, 2, 3, 4 of lines 11, 12 to an end of coupling lines 15, 16, respectively.

Points 1 to 4 are subsequently referred to as first input port, first output port, second output port and second input port, in this order, the distinction between input and output ports being merely a matter of terminology and implying no technical differences. The denominations refer to an arbitrarily chosen propagation direction of a signal in the first line: if this signal enters into the coupler via the first input port 1 and exits via the first output port 2, the outcoupled signal portion is to appear at the second output port 3; an eventual signal portion appearing at the second input port 4 is undesirable.

If the directional coupler is formed alone on the substrate 10, the ports 1 to 4 may indeed be ends of the lines 11, 12 on this substrate; if it is integrated on a substrate together with other components, they can be arbitrary points of a conductor between the directional coupler and another component.

The conductor portion 13-1 is perpendicular to the portions 13-2 and 13-3 and parallel to portion 13-4, in order to prevent magnetical coupling of the portion 13-1 to 13-2 and 13-3. Lines 11, 12 are imaged onto themselves by reflection at a first symmetry line 18.

The second line 12 is a specular image of the first line 11 with respect to a second symmetry line 19 that extends perpendicular to the first symmetry line 18.

Between facing, parallel edges of coupling lines 15, 16, conducting area 20 extends, unconnected to both. It couples capacitively to the first and second line, the strength of the capacitive coupling being essentially determined by the width of the gaps 21 between the conductor area 20 and the coupling lines 15, 16. With a given geometry of the first and second coupling lines 15, 16, i.e. at a given magnetic coupling, this design allows to modify the capacitive coupling between the lines by varying the width of the gaps 21 without implying a change in shape and position of first and second lines 11 to 16, and accordingly, without implying a substantial change of the parasitic capacities acting on these lines.

In order to prevent currents induced in the unconnected conductor area 20 in its longitudinal direction or along its second symmetry line 19 from promoting the magnetic coupling between coupling lines 15, 16, it can be useful, according to a further embodiment not shown in a figure to divide the conductor area 20 into a plurality of separate areas arranged in the longitudinal direction.

In the design of FIG. 2, the capacitive coupling is homogeneously distributed along the whole length of the parallel coupling lines 15, 16, and it is as strong as the magnetic coupling. With such an arrangement, in order to achieve an efficient capacitive coupling in which the contributions of different sections of the coupling lines do not cancel each other, it is desirable to reduce the length of the coupling lines as far as possible. The length of the coupling lines 15, 16 is therefore in any case substantially shorter than $\lambda 1/4$, $\lambda 1$ being the shorter one of two wavelengths, $\lambda 1$, $\lambda 2$ that correspond to the upper and lower limit frequency of a frequency band in which the coupler is effective.

The shortness of the coupling zone on the one hand and the equal strength of magnetic and capacitive coupling prevent resonances in the coupling zone from forming within the frequency band in which the coupler is effective. Therefore, there is no resonant enhancement in the coupling zone, and accordingly, the eradiation is small. Therefore, the influence of fields eradiated by the directional coupler and reflected at the metallization of the opposite substrate side on the behavior of the directional coupler is small. Therefore, a larger phase shift between the signal fed into the coupling zone on one of the lines 11 or 12 and these reflected fields in the coupling zone can be tolerated than with the conventional design principle described above.

This allows to use the directional coupler of the invention on rather thick, sturdy substrates that can be manufactured simply and with a good yield, or, at a given substrate thickness, to operate the directional coupler at comparatively high frequencies.

Figure 3:
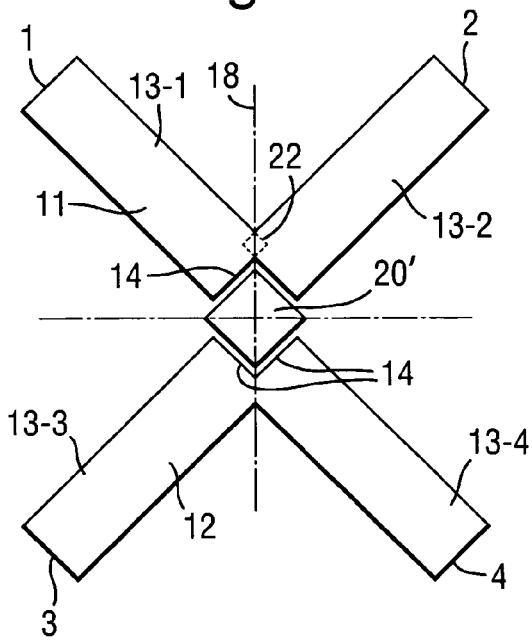

An advanced embodiment having the advantages of the embodiment described above and further ones is shown in FIG. 3. Here, the length of the coupling lines is reduced to zero. The straight sections 13-1 and 13-2 of the first line 11 and 13-3, 13-4 of the second line 12 meet at right angles at the first symmetry line 18. The sections 13-1 to 13-4 are in the form of strips having parallel longitudinal borders and an end edge 14 perpendicular to the longitudinal borders, and they intersect each other in a corner portion of the end edge, shown as a dashed square 22 in the first line 11. The unconnected conductor area 20' is in the shape of a square, the edges of which are parallel to the end edges 14.

Since in this embodiment the length of the coupling zone is minimized, it is not to be expected that in this embodiment magnetic coupling can be further reduced by subdividing the conductor area 20' into several part areas along the symmetry line 19; rather, it is to be expected that such a subdivision will promote magnetic coupling here.

Figure 4:
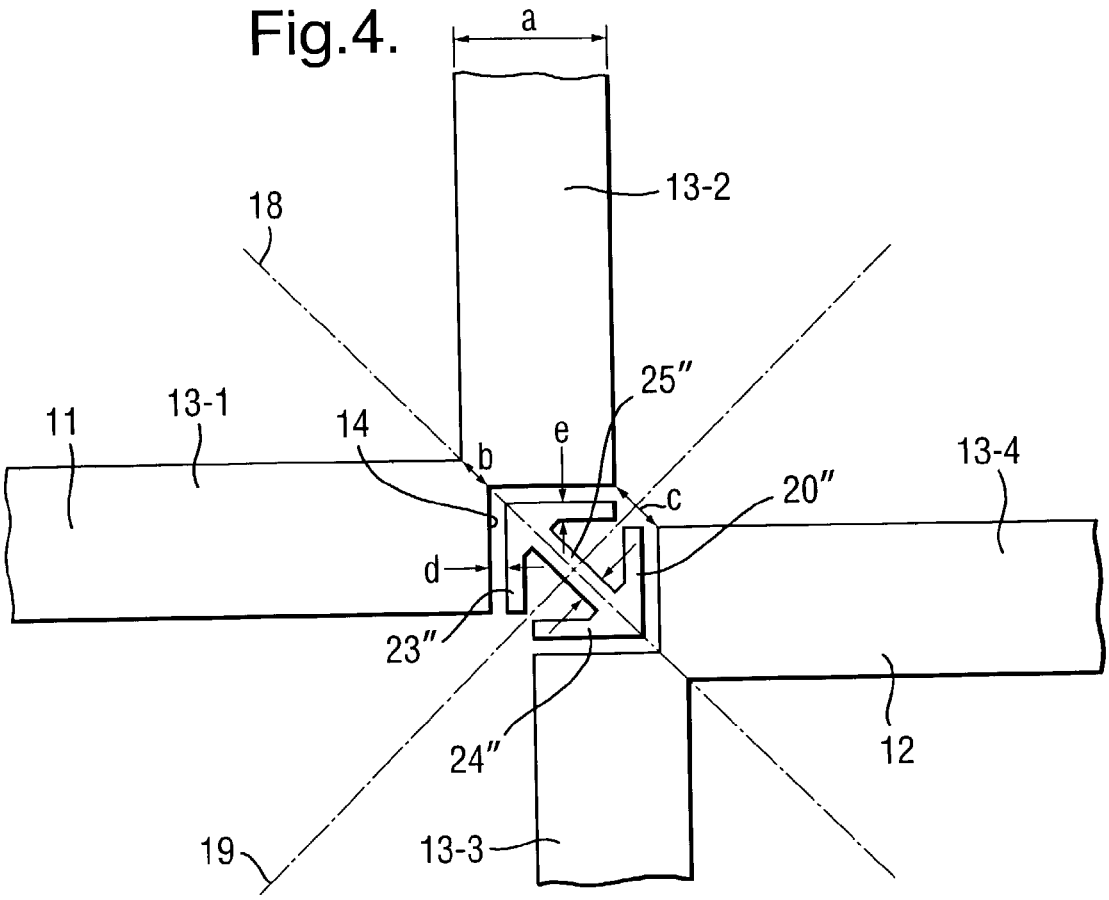

A further improvement is shown in the top view of FIG. 4. Here, the square conductor area 20' is replaced by a conductor area 20" which is essentially square in outline and is formed of three sections 23", 24", 25". The portions 23", 24" are each essentially L-shaped, having legs of equal length facing the end edges 14 of the straight conductor sections 13-1, 13-2, 13-3, 13-4. The section 25" is in the shape of an elongated land joining the vortices of the L-shaped sections 23", 24" along the first symmetry line 18. Charges induced by a signal propagating on the first line 11 in the facing L-shaped section 23" propagate along the land 25" along symmetry line 18 to the second L-shaped section 24" and thus couple capacitively to the second line 12. Any current flows on the conductor area 20" transversely to the symmetry line 18, which would correspond to a magnetic coupling between the first and second lines 11, 12 via the conductor area 20" are suppressed by its shape.

In order to design a directional coupler having the geometry shown in FIG. 4 for a given frequency band, the following parameters can be optimized:

Substrate Material and Thickness

These parameters are mainly relevant for the maximum operating frequency at which the coupler is to be applied. Generally, a small substrate thickness is preferred in order to reduce eradiation. At operating frequencies up to 30 GHz, an alumina substrate having a thickness of 381 $\mu$m is appropriate. At frequencies above 30 GHz, a thickness of 254 $\mu$m is preferred.

Width of the Lines

The width a of lines 11 to 14 is essentially relevant for the line impedance of the system. For an impedance of the lines 11 to 14 of 50 Ω, a width a of 340 $\mu$m is optimum.

Width b of the Intersecting Zone 22

Figure 5:
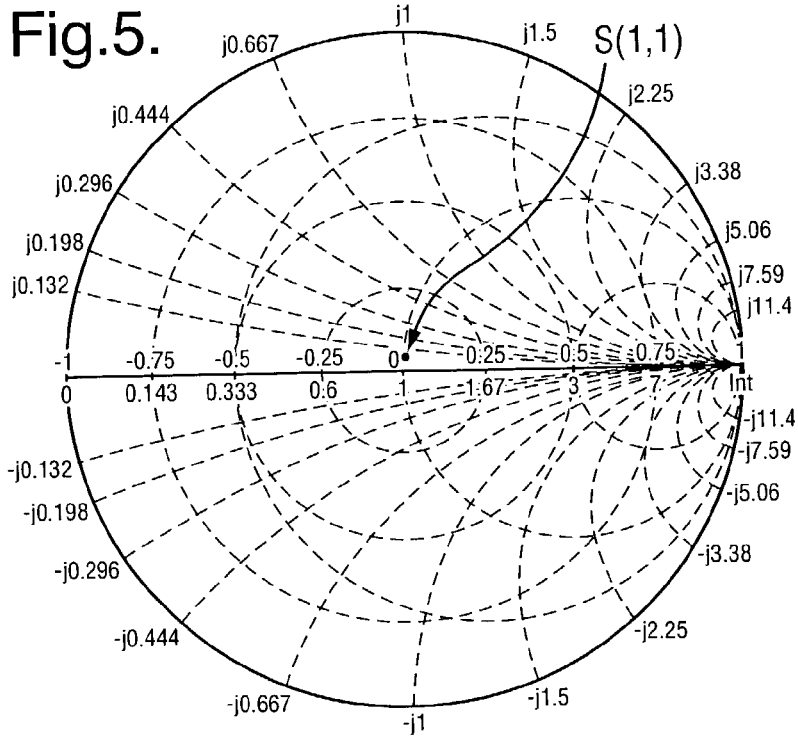
FIG. 5 is a Smith diagram of reflection of a single line of the directional coupler of FIG. 4.

This parameter influences the reflection behavior of the lines. The smaller b is, the more pronouncedly inductive is the reflection behavior. It is desirable that the two lines 11, 12, considered without the conductor area 20 and the corresponding other line 12, 11, respectively, have a weakly inductive behavior, as shown in the Smith diagram of FIG. 5 for the first input line. The reflection S(1,1) at the input of the first line is practically constant in the considered frequency range of 19 to 27 GHz. In the complete directional coupler the weakly inductive behavior of the reflection S(1,1) is essentially compensated by the capacitive contribution of the conductor area 20, so that overall, a minimum reflection is achieved.

Minimum Distance Between First and Second Lines

The distance c between facing corners of the end edges 22 of the first and second lines 11, 12 obviously has an influence on the strength of the coupling between these lines. Preferably, it is selected so that the computer simulation of a directional coupler consisting only of the first and second lines 11, 12, without the unconnected conductor area 20, yields a coupling between the first and second lines which is smaller than the desired coupling by approximately 5 dB. When the unconnected conductor area 20" is inserted in order to achieve magnetic and capacitive couplings of equal strength, the overall coupling increases by approximately 5 dB.

A fine adjustment of the capacitive coupling can be achieved by optimizing the width e of the legs of the L-shaped sections and the width d of the gaps between the L-shaped sections 23", 24" and the end edges 22 of the lines.

An example for an advantageous set of the various geometry parameters is:

a=340 $\mu$m
b=31 $\mu$m
c=116 $\mu$m
d=30 $\mu$m
e=30 $\mu$m.

Figure 6:
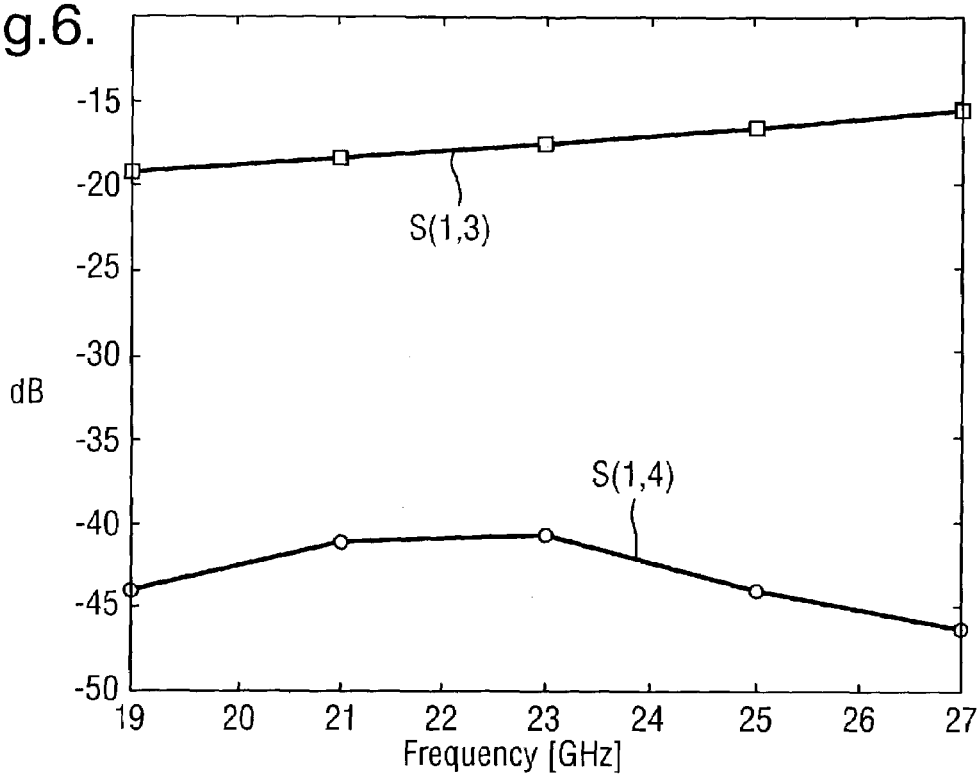
FIG. 6 illustrates signal intensities at the second output line and the second input line of the directional coupler of FIG. 4 under excitation by the first input line for various frequencies of the exciting signal.
Figure 7:
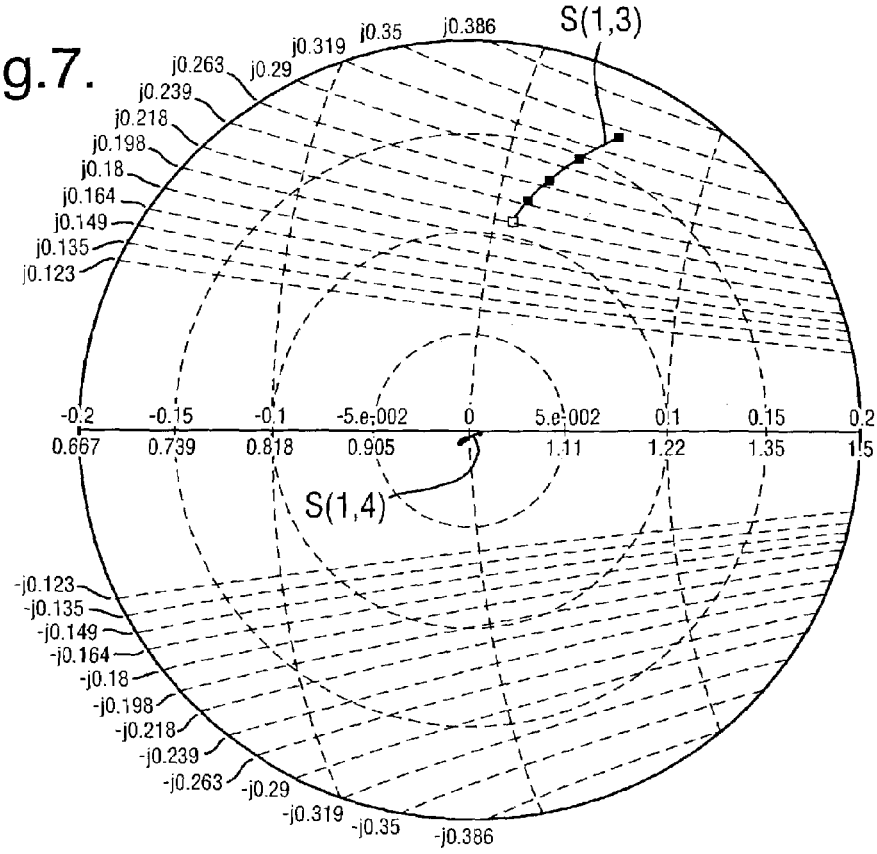
FIG. 7 is a Smith diagram of the desired and the undesired couplings of the directional coupler of FIG. 4.

FIGS. 6 and 7 show, for various signal frequencies, the strength S(1,3) of the desired signal transmitted from the first input port 1 to the second output port 3 and S(1,4) of the undesired signal appearing at the second input port 4 for a directional coupler having the values of parameters a to e given above. An excellent directivity with a level difference of more than 20 dB between the two signals S(1,3) and S(1,4) is recognized in the whole examined frequency range of 19 to 20 GHz. The phase drift of the signal at the second output port 3 as a function of frequency is small, as shown by the Smith diagram of FIG. 7.

In short, the present invention achieves an extremely compact directional coupler having a large bandwidth and an excellent directivity. Whereas in conventional directional couplers extremely thin substrates must be used in order to achieve a satisfying directivity at high operating frequencies, according to the present invention comparatively thick substrates can be used, whereby the durability of the coupler and the production yield is improved and costs are reduced.

I claim:

1. A directional coupler, comprising: a substrate; two first ports on the substrate and connected by a first line; two second ports on the substrate and connected by a second line; the lines extending through a coupling zone and being separated by a spacing; and a conductor in the spacing, the conductor being capacitively coupled and unconnected to both lines, for directionally coupling a signal having a wavelength within a band from one of the two lines to the other line, the coupling zone being shorter than a quarter of the shortest wavelength of the band, and magnetic and capacitive couplings being equally strong at any location of the coupling zone.

2. A directional coupler, comprising: a substrate; two first ports on the substrate and connected by a first line; two second ports on the substrate and connected by a second line; the lines extending through a coupling zone, each line comprising two straight sections meeting each other in the coupling zone at an angle, the bisectrix being the same for the angles of both lines, the lines in the coupling zone being separated by a spacing; and a conductor in the spacing, the conductor being capacitively coupled and unconnected to both lines.

3. The directional coupler according to claim 2, wherein the straight sections are in the form of strips having an end edge perpendicular to the borders of the strips, and wherein the two straight sections of each line intersect at a corner of their end edge.

4. A directional coupler, comprising: a substrate; two first ports on the substrate and connected by a first line; two second ports on the substrate and connected by a second line; the lines extending through a coupling zone, the lines in the coupling zone being separated by a spacing; and a conductor in the spacing, the conductor being capacitively coupled and unconnected to both lines, the conductor being formed of two L-shaped sections facing the first and second lines respectively and connected by a land-shaped conductor section.

5. The directional coupler according to claim 4, wherein the coupler has a first symmetry axis, wherein a specular reflection at the first symmetry axis transforms each line into itself, and wherein the land-shaped conductor section extends along the first symmetry axis.

6. A directional coupler, comprising: a substrate; two first ports on the substrate and connected by a first line; two second ports on the substrate and connected by a second line; the lines extending through a coupling zone, the lines in the coupling zone being separated by a spacing; and a conductor in the spacing, the conductor being capacitively coupled and unconnected to both lines, the conductor contributing about 5 dB to a capacitive coupling between the first and second lines.

7. The directional coupler according to claim 6, wherein the lines extend in mutually perpendicular directions outside the coupling zone.

8. The directional coupler according to claim 6, wherein the lines exhibit an inductive behavior in the coupling zone.

* * * * *